US010041678B2

(12) United States Patent
Miura et al.

(10) Patent No.: US 10,041,678 B2
(45) Date of Patent: Aug. 7, 2018

(54) GAS TURBINE COMBUSTOR WITH A PREMIXING BURNER HAVING A REDUCED METAL TEMPERATURE BY INJECTING AIR ALONG A BURNER END FACE

(71) Applicant: Mitsubishi Hitachi Power Systems, Ltd., Yokohama, Kanagawa (JP)

(72) Inventors: Keisuke Miura, Tokyo (JP); Satoshi Dodo, Tokyo (JP); Tomomi Koganezawa, Tokyo (JP); Yoshitaka Hirata, Tokyo (JP); Kazuki Abe, Tokyo (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 1168 days.

(21) Appl. No.: 14/018,469

(22) Filed: Sep. 5, 2013

(65) Prior Publication Data

US 2014/0083102 A1 Mar. 27, 2014

(30) Foreign Application Priority Data

Sep. 24, 2012 (JP) ..... 2012-209073

(51) Int. Cl.
*F23R 3/28* (2006.01)
*F23R 3/34* (2006.01)
(Continued)

(52) U.S. Cl.
CPC ..... *F23R 3/286* (2013.01); *F23D 14/82* (2013.01); *F23R 3/10* (2013.01); *F23R 3/343* (2013.01)

(58) Field of Classification Search
CPC ..... F23R 3/283; F23R 3/286; F23R 3/343; F23R 2900/03282; F23R 2900/03343;
(Continued)

(56) References Cited

U.S. PATENT DOCUMENTS 5,239,831 A * 8/1993 Kuroda ..... F23R 3/16 60/733
5,515,680 A * 5/1996 Fujimura ..... B01F 5/0405 239/434
(Continued)

FOREIGN PATENT DOCUMENTS

EP 1 985 926 A2 10/2008
EP 2 236 936 A2 10/2010
(Continued)

OTHER PUBLICATIONS

Horst Glenz et al., Grenzspaltweite bzw. Löschabstand für Gemische aus mehreren Brennstoff-komponenten mit Luft, Chemie Ingenieur Technik, vol. 52, No. 2, Jan. 1, 1980, pp. 172-173.
(Continued)

*Primary Examiner* — William H Rodriguez
*Assistant Examiner* — Jason H Duger
(74) *Attorney, Agent, or Firm* — Crowell & Moring LLP

(57) ABSTRACT

A combustor has at least one premixing burner for premixing fuel with air and jetting the mixed gas into a chamber for combustion. A cylinder attached to an outer circumferential portion of an end face of the burner is provided with air supply holes. An interval D1 defined between the adjacent air supply holes and an interval D2 defined between each air supply hole and the end face of the burner are each made narrower than the quenching distance in the premixed gas jetted from the premixing burner.

10 Claims, 10 Drawing Sheets

(51) Int. Cl.
*F23D 14/82* (2006.01)
*F23R 3/10* (2006.01)

(58) Field of Classification Search
CPC ..... F23R 3/04; F23R 3/06; F23R 3/10; F23R 3/36; F23R 2900/00014; F23R 2900/03041; F23R 2900/03042; F23R 3/346; F23D 14/62; F23D 14/64; F23D 14/82
See application file for complete search history.

(56) References Cited

U.S. PATENT DOCUMENTS 6,427,446 B1 * 8/2002 Kraft ..... F23R 3/06 60/737
6,732,528 B2 * 5/2004 Akagi ..... F23R 3/002 60/746
6,910,336 B2 * 6/2005 Sullivan ..... F23R 3/002 60/39.37
6,928,823 B2 * 8/2005 Inoue ..... F02C 7/22 60/737
6,964,170 B2 * 11/2005 Alkabie ..... F23R 3/002 60/725
8,113,000 B2 * 2/2012 Laster ..... F23R 3/14 60/39.11
8,763,399 B2 * 7/2014 Dodo ..... F23R 3/343 431/181
2004/0011054 A1 1/2004 Inoue et al.
2008/0268387 A1 * 10/2008 Saito ..... F23R 3/286 431/8
2009/0282833 A1 * 11/2009 Hessler ..... F23R 3/002 60/757
2011/0154829 A1 * 6/2011 Hayashi ..... F23D 14/64 60/776
2011/0203250 A1 * 8/2011 Huber ..... F23R 3/002 60/39.23

FOREIGN PATENT DOCUMENTS

JP 2003-148734 A 5/2003
WO WO 2009/005516 A2 1/2009

OTHER PUBLICATIONS

EP Search Report of Appln. No. 13182874.1 dated Nov. 7, 2013 in English.

* cited by examiner

※Cited document: Lewis,B., von Elbe, G.: Combustion, Flames and Explosions of Gases, 2ns ed., Academic Press (1961):

GAS TURBINE COMBUSTOR WITH A PREMIXING BURNER HAVING A REDUCED METAL TEMPERATURE BY INJECTING AIR ALONG A BURNER END FACE

BACKGROUND OF THE INVENTION

1. Field of the Invention

The present invention relates to a gas turbine combustor.

2. Description of the Related Art

Gas turbines have been required to promote the further reduction of NOx from the viewpoint of environmental conservation. One of measures to promote the reduction of NOx in a gas turbine combustor is to employ a premixing combustor. By contrast, JP-2003-148734-A discloses a combustor that includes a fuel combustion nozzle having a large number of fuel nozzles to supply fuel to a chamber and a large number of air holes located on the downstream side of the fuel nozzles so as to supply air, with jet holes of the fuel nozzles being each arranged coaxially with a corresponding one of the air holes. Thus, the combustor provides both anti-flashback property and low-NOx combustion.

SUMMARY OF THE INVENTION

JP-2003-148734-A does not discuss problems with the variation of a flame-holding position and a rise in metal temperature which may occur when the mixing of fuel and air inside the air hole is promoted.

It is an object of the present invention, therefore to provide a combustor that can form stable flame and reduce the metal temperature at a liner and an outlet end face of a burner.

According to an aspect of the present invention, there is provided a gas turbine combustor comprising: at least one premixing burner for premixing gaseous fuel with air and jetting the mixed gas into a chamber; a cylinder disposed on an outer circumference of the premixing burner so as to surround the premixing burner and connected to a burner outlet end face which is an end face of the premixing burner on the chamber side; and a plurality of air supply holes formed in the cylinder; wherein an interval defined between the adjacent air supply holes is smaller than a quenching distance in the premixed gas jetted from the premixing burner, and wherein an interval defined between each air supply hole and the burner outlet end face is smaller than the quenching distance in the premixed gas jetted from the premixing burner.

The present invention can provide the combustor that can form stable flame and reduce the metal temperature at a liner and a burner outlet end face.

DESCRIPTION OF THE PREFERRED EMBODIMENTS

Preferred embodiments of the present invention will be described below.

(First Embodiment)

Figure 3:
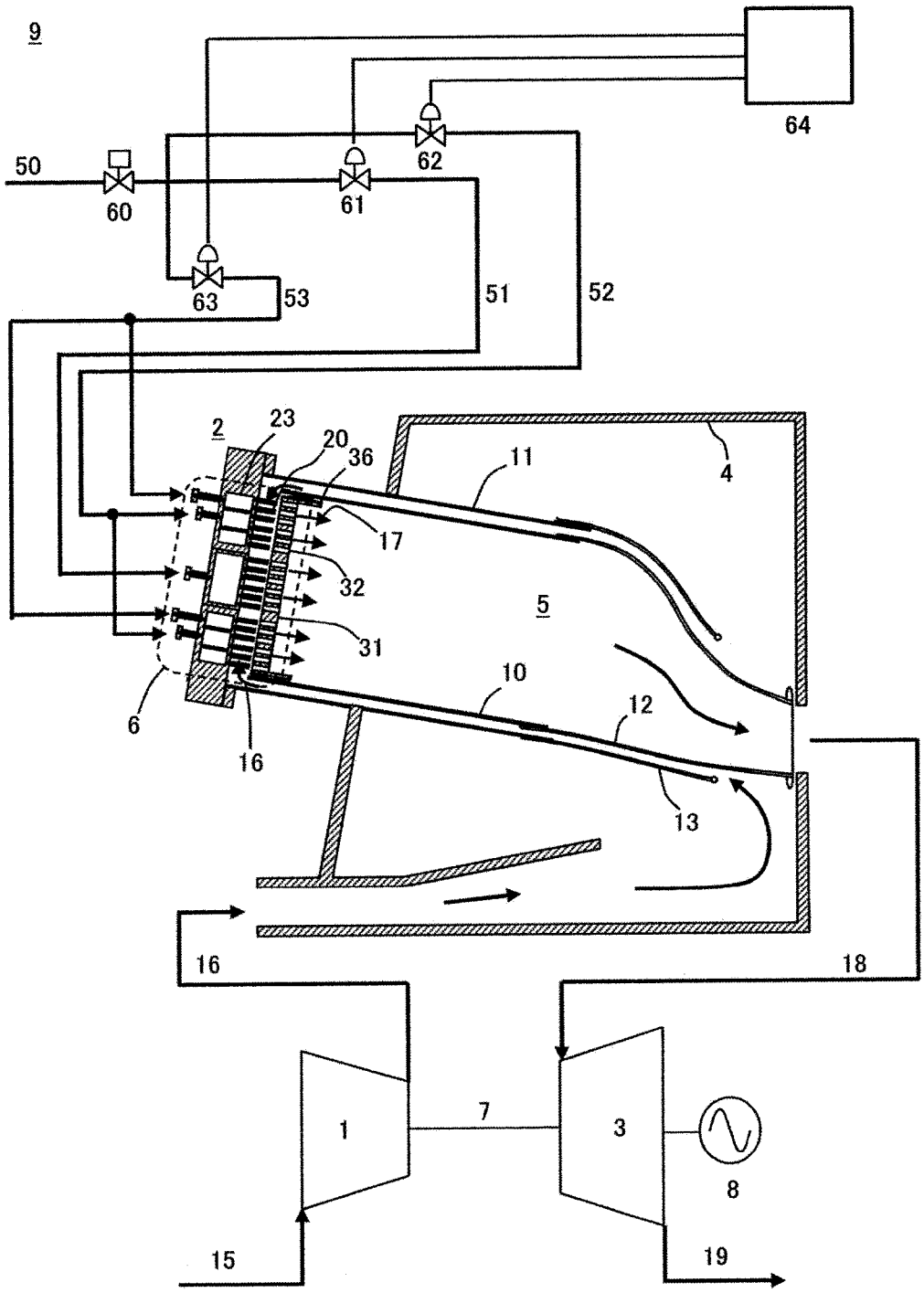
FIG. 3 is a system diagram illustrating a schematic configuration of a gas turbine plant to which the gas turbine combustor of the first embodiment is applied.

FIG. 3 is a system diagram illustrating the entire configuration of a gas turbine plant for power generation.

Referring to FIG. 3, a gas turbine for power generation includes: a compressor 1 for pressurizing intake air 15 to generate high-pressure air 16; a combustor 2 for burning the high-pressure air 16 generated by the compressor 1 and gaseous fuel 50 to generate high-temperature combustion gas 18; a turbine 3 driven by the high-temperature combustion gas 18 generated by the combustor 2; a generator 8 rotated by the driving of the turbine 3 to generate electric power; and a shaft 7 for integrally connecting the compressor 1, the turbine 3 and the generator 8 together.

The combustor 2 is accommodated in the inside of a casing 4. The combustor 2 has a multi-burner 6 at its head portion. The multi-burner 6 is composed of a plurality of burners. In addition, the combustor 2 has a generally cylindrical combustor liner 10 therein on the downstream side of the multi-burner 6. The combustor liner 10 is adapted to isolate high-pressure air from combustion gas.

A flow sleeve 11 is disposed on the outer circumference of the combustor liner 10. The flow sleeve 11 serves as an outer circumferential wall defining an air passage adapted to allow high-pressure air to flow therein. The flow sleeve 11 has a diameter greater than that of the combustor liner 10 and is cylindrically arranged nearly coaxially with the combustor liner 10.

A transition piece 12 is disposed on the downstream side of the combustor liner 10 so as to lead to the turbine 3 the high-temperature combustion gas 18 generated in a chamber 5 of the combustor 2. A flow sleeve 13 surrounding the transition piece 12 is disposed on the outer circumferential side of the transition piece 12.

The intake air 15 that has been compressed by the compressor 1 becomes high-pressure air 16. The high-pressure air 16 is filled in the casing 4, and then flows in a space between the transition piece 12 and the flow sleeve 13 surrounding the transition piece 12 to convectionally cool the transition piece 12 from its outer wall surface.

Further, the high-pressure air 16 passes through an annular passage defined between the flow sleeve 11 and the combustor liner 10 and flows toward the head portion of the combustor. The high-pressure air 16 that has flowed in the multi-burner 6 flows into a number of air holes 32 formed in an air hole plate 31. The air hole plate 31 is located on an upstream-side wall surface of the chamber 5.

The high-pressure air 16 that has flowed in the air holes 32 mixes with the gaseous fuel jetted from a fuel nozzle 20 and then premixed gas 17 thus mixed flows into the chamber 5. The premixed gas 17 burns in the chamber 5 to generate high-temperature combustion gas 18. This high-temperature combustion gas 18 is supplied to the turbine 3 through the transition piece 12. The high-temperature combustion gas 18 thus supplied to the turbine 3 drives the turbine 3 and then is discharged as exhaust gas 19 to the outside.

The drive force produced in the turbine 3 is transmitted to the generator 8 and to the compressor 1 through the shaft 7. A portion of the drive force produced in the turbine 3 drives the compressor 1 to pressurize air to generate high-pressure air. Another portion of the drive force produced in the turbine 3 rotates the generator 8 to generate electric power.

The multi-burner 6 has three fuel systems, i.e., gaseous fuel systems 51, 52 and 53, which have fuel flow control valves 61, 62 and 63. The flow rate of each of the gaseous fuel systems is controlled by controlling the opening degree of the corresponding fuel flow control valve in response to a signal from a control unit 64. Thus, a power generation amount of the gas turbine plant 9 is controlled. A fuel cutoff valve 60 for cutting off fuel is located on the upstream side of a diverging point of the three fuel systems.

Figure 1:
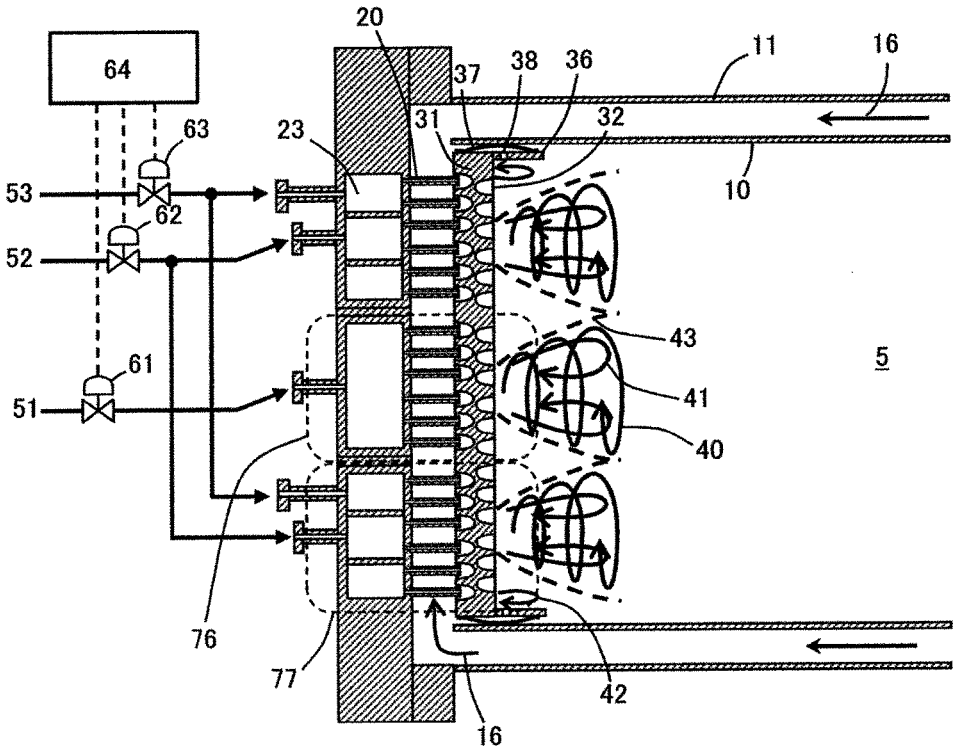
FIG. 1 is a detailed cross-sectional view of a burner portion of a gas turbine combustor according to a first embodiment, additionally illustrating fuel systems and a control unit.
Figure 2:
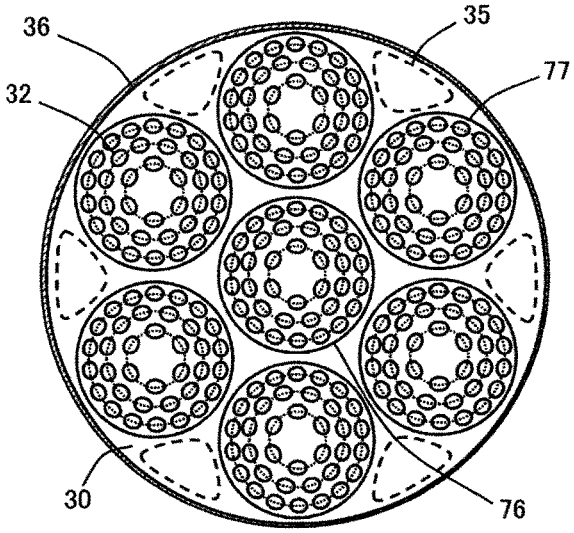
FIG. 2 is a front view of the burner of the first embodiment shown in FIG. 1 as viewed from a chamber side.

The details of the multi-burner 6 are shown in a cross-sectional view of FIG. 1. A front view of the air hole plate 31 viewed from the chamber 5 side is shown in FIG. 2. The multi-burner 6 of the present embodiment is composed of a central burner 76 and six external burners 77. Each of the burners includes a number of fuel nozzles 20; a fuel header 23 to distribute gaseous fuel into the fuel nozzles 20; and the air hole plate 31 in which the air holes 32 through which air and fuel pass are each arranged to face a corresponding one of the fuel nozzles. As shown in the front view in FIG. 2, the air holes 32 of each burner are arranged on triple concentric circles. The gaseous fuel system 51 is connected to the central burner. The external burners are divided into two groups: an inner circumferential portion connected to the gaseous fuel systems 52 and an outer circumferential portion connected to the gaseous fuel systems 53.

Figure 7:
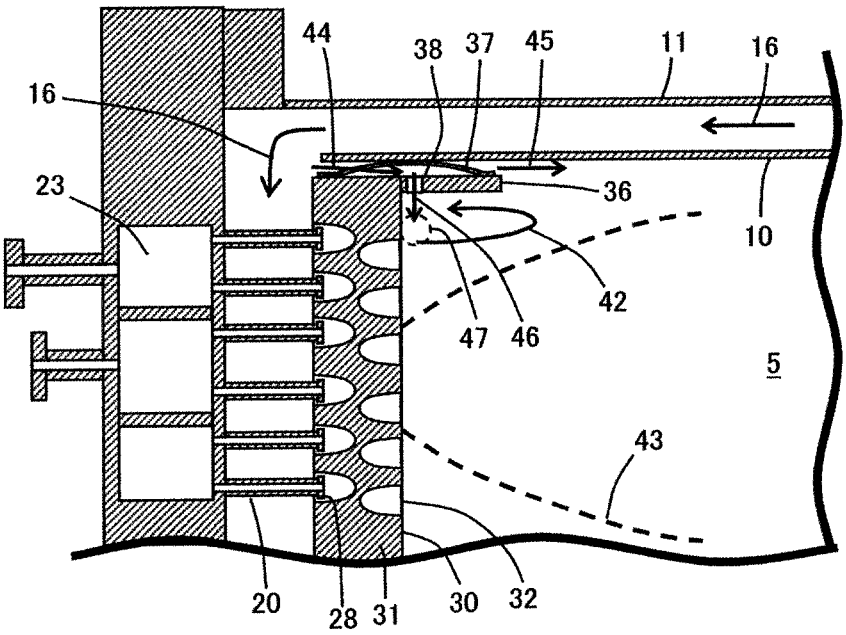
FIG. 7 is an enlarged cross-sectional view of external burners according to the first embodiment.

As shown in an enlarged cross-sectional view of the external burner 77 in FIG. 7, a rib 28 is attached to the tip of the fuel nozzle 20. Further, the tip of the fuel nozzle 20 is inserted into the inside of the air hole 32. Therefore, when air 16 passes the rib 28 located at the tip of the fuel nozzle, a swirl occurs. This can promote mixing of a fuel jet with the air 16. In addition, fuel and air can be premixed through the air hole with a short length.

As shown in FIG. 1, the air holes 32 are each inclined with respect to the central axis of the burner at its outlet facing the chamber 5 to form conical flames. In doing so, a swirl flow 40 is formed downstream of the burner. Specifically, since negative pressure prevails at the central portion of the swirl flow 40, recirculation flows 41 are formed. The recirculation flows 41 carry high-temperature combustion gas from the downstream side to upstream side of the chamber, thereby supplying heat to the premixed gas. This mechanism can stably hold flames 43 and shape the flames 43 conically, starting from the air hole of the first row from the center of the burner. Because of the formation of the conical flame 43, a distance from the outlet of the air hole 32 to the flame 43 can be increased. Also after being jetted from the air hole 32, fuel and air can further be mixed with each other, thereby allowing for low-NOx combustion.

The combustor is internally subjected to significantly high temperatures which are different depending on positions. Therefore, a difference in thermal extension occurs between the liner 10 and the flow sleeve 11. Thus, securing completely the burner and the liner 10 to each other generates stress at its secured portion due to the difference in thermal extension, which is likely to lead to the breakage of the secured portion. To prevent such breakage, a method is conceivable in which a spring-like seal member is attached to the outer circumferential portion of the burner and the burner is inserted into and secured to the inside of the liner 10. In this case, the liner 10 can be secured in the radial direction of the combustor by means of the spring-like seal member but is unconstrained in the axial direction. Thus, the difference in thermal extension between the liner 10 and the flow sleeve 11 can be absorbed.

If the air hole plate 31 is made thick, then a risk occurs in which flames flow back into the air holes and burn out the air hole plate 31. Therefore, in the present embodiment, the air hole plate 31 is made to have a minimum thickness necessary to mix fuel with air. In view of the mixing of fuel with air, the air hole plate 31 is made to have the minimum thickness. Therefore, the spring-like seal member cannot be secured only by the air hole plate 31. Thus, in the present embodiment, a cylindrical guide 36 with air supply holes 38 is attached to the outer circumferential portion of the air hole plate 31. In addition, the spring-like seal member 37 is attached to the outer circumference of the cylindrical guide 36 and the burner is inserted into the inside of the liner 10. Incidentally, the cylindrical guide 36 is configured to be joined to a burner outlet end face 30 to surround the multi-burner 6.

Figure 4:
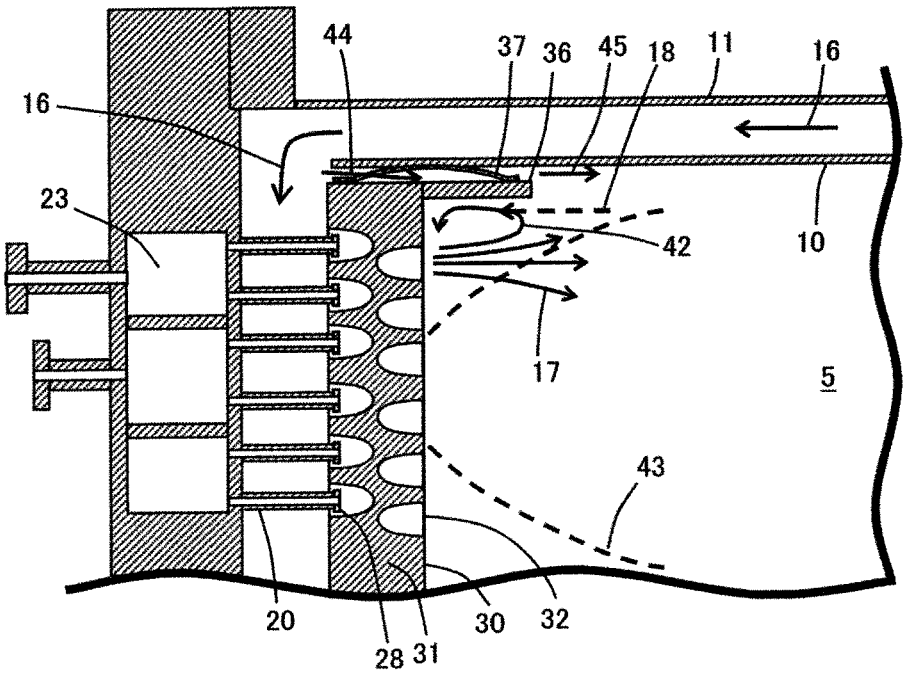
FIG. 4 is an enlarged cross-sectional view of external burners of the combustor.

FIG. 4 is a detailed cross-sectional view illustrating an external burner 77 in the case where a cylindrical guide 36 is not provided with the air supply holes 38 unlike the external burner 77 of the present embodiment. Along with the flow of premixed gas 17 jetted from the air holes of the external burner, recirculation flows 42 occur in an area between the outermost circumferential air holes of the external burner 77 and the cylindrical guide 36. To further reduce NOx than the combustor in JP-A-2003-148734, the tip of a fuel nozzle is provide with a rib 28 which is inserted into the inside of the air hole 32, whereby fuel and air are premixed in the inside of the air hole. In addition, the air holes are inclined with respect to the central axis of the burner to form swirl flows on the downstream of the burner, thereby forming a conical flame 43. Thus, the distance for the mixing of fuel with air in the chamber 5 is increased.

The premixed gas 17 that is jetted from the air holes in the outer circumferential portion of the burner circumferentially diffuses until it will reach the flame 43. Therefore, a portion of the premixed gas 17 is taken in the recirculation flow 42 at the outer circumferential portion of the burner and stays thereat. For the multi-burner, as shown in FIG. 2, a large dead space 35 is located between adjacent burners, where larger recirculation flows are formed. A flow field in the chamber 5 is largely varied by the swirl flows. Therefore, as shown in FIG. 4, high-temperature combustion gas 18 generated by the flame 43 may temporarily flow back toward the upstream side in the space between the external burner 77 and the cylindrical guide 36 in some cases.

Figure 5:
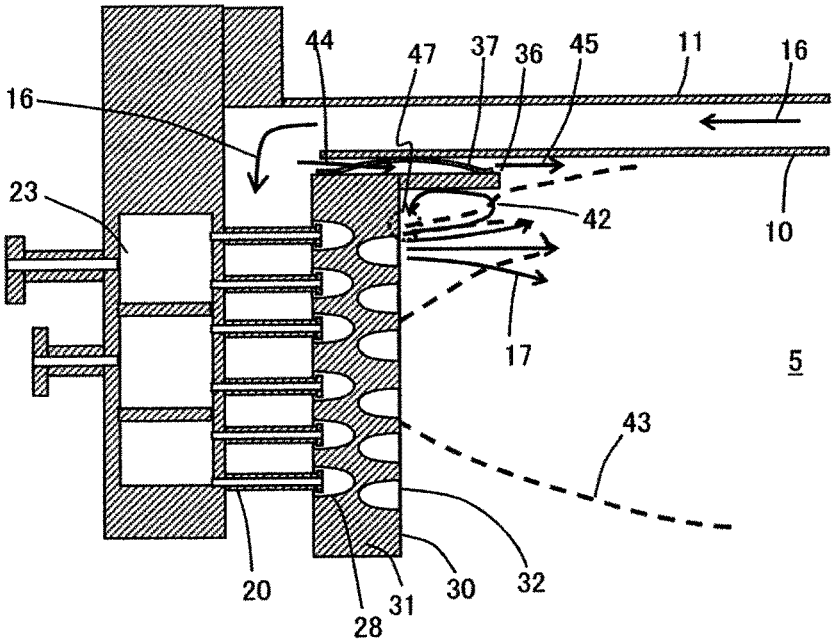
FIG. 5 is an enlarged cross-sectional view of the external burners of the combustor.

In this case, the recirculation flow 42 is filled with the premixed gas 17; therefore, the premixed gas is ignited by the high-temperature combustion gas, so that the temperature of overall recirculation flow is raised to high. If the inside temperature of the recirculation flow is once raised to high, the flame 43 is deformed as shown in FIG. 5 and held, starting from an air hole outlet circumference 47 in the outermost circumference of the external burner. The flame 43 that is held, starting from the air hole outlet circumference 47 in the outermost circumference of the external burner, is steadily held because the high-temperature combustion gas is supplied to the flame 43 by the recirculation flows 42 on the outside of the burner. As a result, the flame 43 comes close to the cylindrical guide 36 and the liner 10, whereby their metal temperatures are raised. Since a flame position is shifted toward the upstream side, a net distance for the mixing of fuel with air is reduced, so that the discharge amount of NOx is likely to increase.

Figure 6:
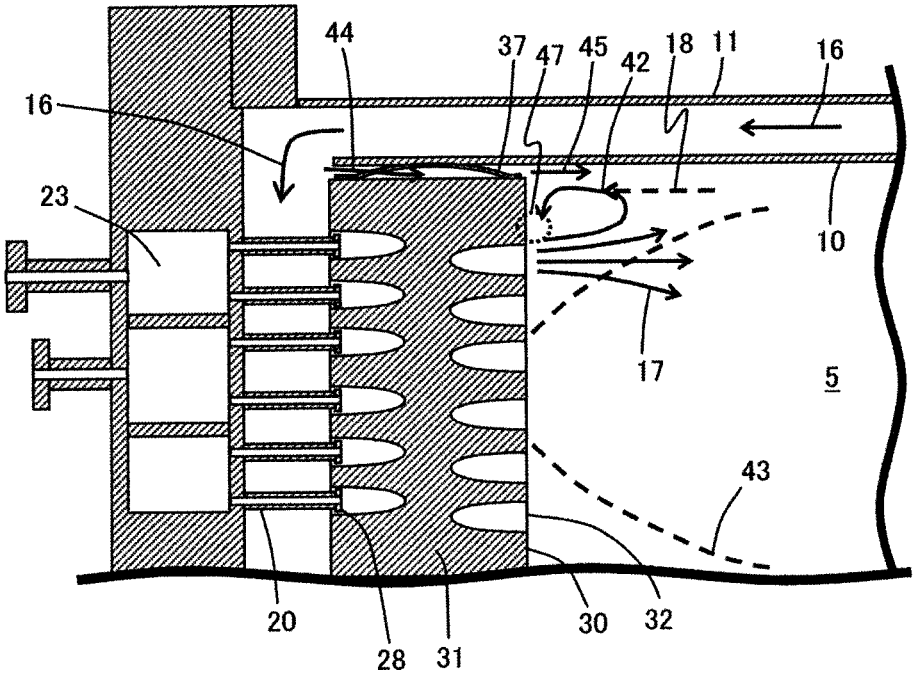
FIG. 6 is an enlarged cross-sectional view of external burners of the combustor.

Also if the air hole plate is made thick and is not provided with a cylindrical guide as shown in FIG. 6, the recirculation flow 42 is formed on the outer circumferential portion of the burner along with the flow of the premixed gas 17 jetted from the air holes 32. Leaking air 45 that passes the spring-like seal member 37 flows into the inside of the chamber 5. However, the leaking air 45 flows along the liner 10 but has little mixture with the recirculation flow 42. Therefore, the premixed gas stays in the recirculation flow 42. The premixed gas in the recirculation flow 42 is ignited by the high-temperature combustion gas 18 temporarily flows back toward the upstream and similarly to that of FIG. 5, flame is held, starting from the air hole outlet circumference 47 in the outermost circumference of the external burner.

Figure 8:
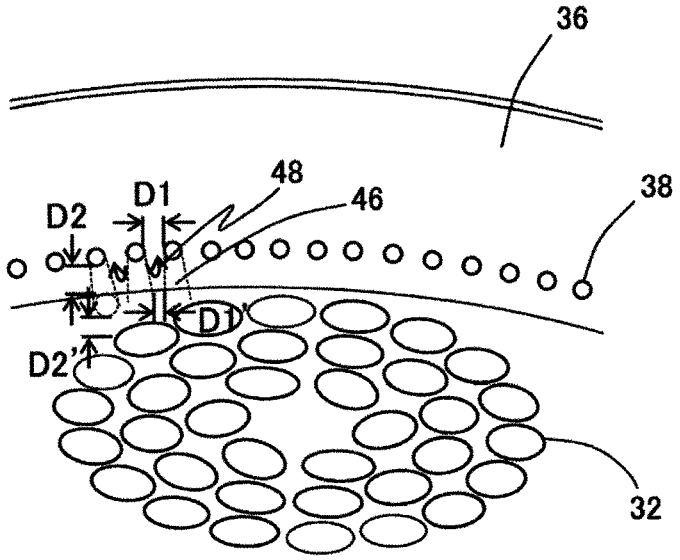
FIG. 8 is a perspective view of an external burner end face and a cylindrical guide according to the first embodiment.

As shown in FIGS. 7 and 8, the cylindrical guide 36 attached to the burner outer circumference on the chamber 5 side is provided with air supply holes 38 in the present embodiment. The air supply holes 38 are open near the outlet end face 30 of the burner in the radial direction of the combustor (toward the outlet end face 30). In this embodiment, the air supply holes 38 are open parallel to the outlet end face 30. The spring-like seal member 37 is provided with slits to provide an elastic function. The air 44 that has passed through a gap between the liner 10 and the air hole plate 31 passes the seal member 37, and a portion thereof passes the seal member as it is and is supplied as leaking air 45 to the chamber 5. In addition, the residual air passes through the air supply holes 38 and is jetted as an air jet 46 into the chamber 5.

The air jet 46 flows along the burner outlet end face 30 toward the central direction of the burner and flows into the air hole outlet circumference 47 in the outermost circumferential portion of the external burner 77. In the present embodiment, an interval D1 defined between the adjacent air supply holes 38 is made shorter than a quenching distance of flames. In addition, an interval D2 defined between the air supply hole 38 and the burner outlet end face 30 is made shorter than the quenching distance of flames.

In the air hole outlet circumference 47 of the external burner outermost circumference capable of acting as an origination for holding flames, no fuel exists in the area at which the air jet 46 directly arrive, so that flames cannot be held. The interval defined between adjacent air jets 46 and the interval defined between the air jet 46 and the burner outlet end face 30 are equal to or smaller than the quenching distance. Therefore, even if a fuel air ratio in such a space is high, flames cannot be held. Thus, a variation in the shape of flame can be suppressed so as to maintain a conical flame 43.

Figure 9:
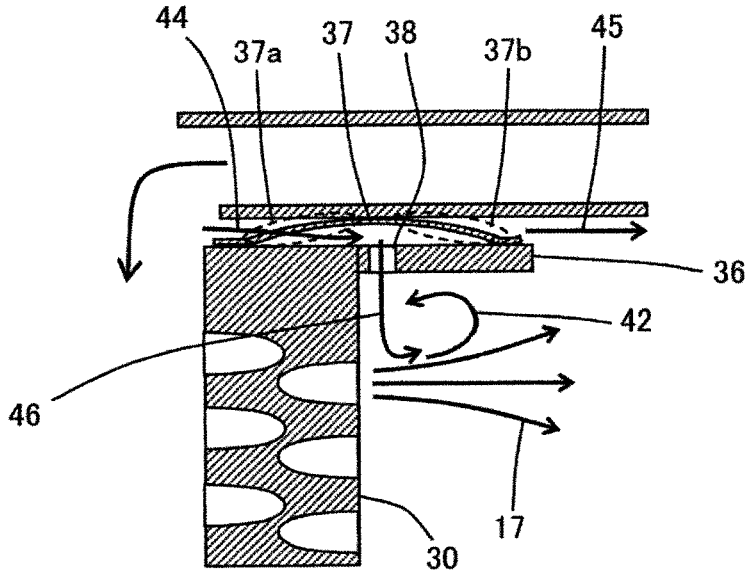
FIG. 9 is an enlarged cross-sectional view of the external burner according to the first embodiment.

As shown in FIG. 9, the air jet 46 that has reached the burner outer circumferential portion is changed in flow direction by the premixed gas 17, so that the air flow 46 is taken in the recirculation flow 42 in place of a portion of the premixed gas 17 being taken therein. Therefore, the fuel air ratio of the recirculation flow 42 significantly lowers, thereby making it possible to prevent flame from propagating in the recirculation flow.

In a case, however, where the jetting velocity of the air jet 46 may be sufficiently faster than that of the premixed gas 17 jetted from the air hole 32, and where the air supply hole 38 and the outlet of the air hole 32 may be very close to each other, there is a possibility that the flow of the premixed gas 17 is obstructed to cause unstable combustion. Further, the air jet 46 jetted from the air supply hole 38 close to the air hole 32 may not be taken in the recirculation flow 42.

To solve such a problem, it is conceivable, for example, to make a passage sectional area of a spring-like seal member upstream side 37*a* smaller than that of the air supply hole 38 and that of a spring-like seal member downstream side 37*b*, thereby reducing the jetting velocity of the air jet 46. In this way, the inertia force of the air jet 46 is weakened to minimize an influence on the flow of the premixed gas jetted from the air hole 32, thereby ensuring that the air jet 46 can be taken in the recirculation flow 42.

As described above, the cylindrical guide surrounding the burners is provided with the air supply holes 38. In addition, the interval D1 defined between the adjacent air supply holes 38 and the interval D2 defined between the air supply hole 38 and the burner outlet end face 30 are each made smaller than the quenching distance. This configuration can suppress the rise in metal temperature due to the variation of the shape of flame and due to the approach of flame to the cylindrical guide and the liner. Further, the air jet 46 flows along the burner outlet end face 30 to form a layer of air on the surface of the burner, thereby making it possible to lower the temperature of the burner outlet end face 30. In short, stable flame can be formed and the metal temperature of the liner and the burner end face can be lowered.

Further, if the air hole plate 31 is made thick, the premixing burner that supplies the premixed gas of fuel and air to the chamber via the plurality of air holes provided in the air hole plate 31 has a risk in which flame flows backward into the air holes and burns out the air hole plate 31. If the air hole plate 31 is simply reduced in thickness, it is difficult to attach the seal member to the air hole plate 31 in some cases. However, the configuration of the present embodiment can ensure the space for the attachment of the seal member by means of the cylindrical guide and allow the air hole plate 31 to have the minimum thickness necessary to mix fuel with air. In this way, the risk in which flame flows backward into the air holes can be reduced. Therefore, the formation of stable flame and a reduction in the metal temperature of the liner and the burner end face can be achieved more significantly.

Figure 10:
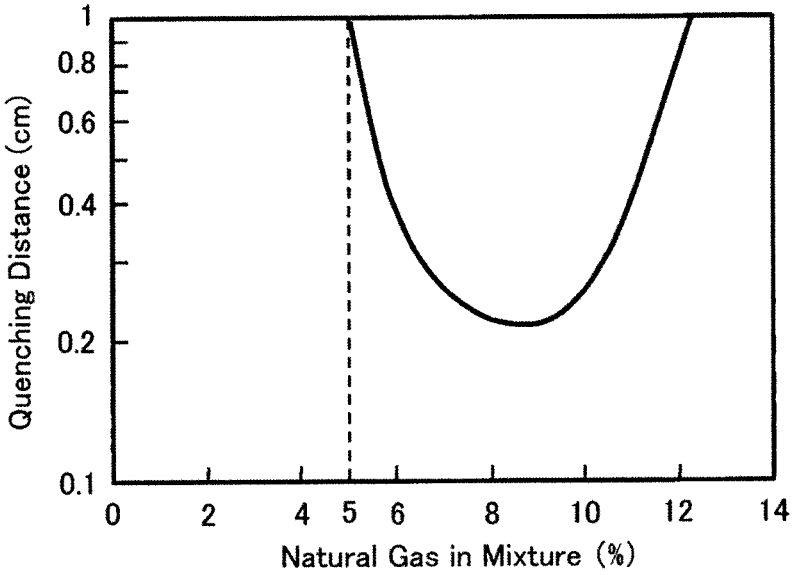
FIG. 10 shows the relationship between natural gas concentration in premixed gas and a quenching distance.

Although, with the improve of the efficiency of a gas turbine, gas temperature at an inlet of a turbine tends to rise, exceeding a frame temperature of 1600° C. causes, even premixed combustion, a quantity of NOx to be discharged, i.e., the same amount of NOx as that of diffusion combustion or the amount of NOx greater than that of diffusion combustion depending on conditions. A premixed combustion method, therefore, is often applied to gas turbine combustors when flame has a temperature of 1600° C. or lower. At an air temperature of 400° C., which is an average temperature at the outlet of a compressor under the full load conditions of a gas turbine, natural gas concentration in premixed gas by which flame temperature becomes 1600° C. is approximately 5%. In this case, as shown in the graph of FIG. 10 concerning the relationship between the natural gas concentration in premixed gas and a quenching distance, the quenching distance corresponding to a natural gas concentration of 5% is approximately 1 cm. Therefore, in the gas turbine combustor employing the premixed combustion operated under the above conditions, setting the intervals D1 and D2 to 1 cm or less is effective to prevent frame from adhering to the outer circumferential portion of the premixed burner.

The quenching distance in FIG. 10 is data obtained at atmospheric pressure and room temperature. The quenching distance tends to be reduced depending on a rise in pressure and in air temperature. However, the air jet 46 is jetted while circumferentially spreading as shown in FIG. 8. Further, the air jet 46 is jetted toward the center of the combustor. Therefore, the interval defined between the air jets 46 is gradually narrowed as it comes close to the center of the combustor. An interval D1' defined between the adjacent air jets 46 and an interval D2' defined between the air jet 46 and the burner outlet end face 30 at the time of arrival at the outer circumferential portion of the burner are smaller than the intervals D1 and D2, respectively.

When the air jet 46 is jetted from the air supply hole 38, a slipstream 48 occurs and a portion of the air jet 46 flows into also between the air jet 46 and the other air jet 46. A certain amount of air flows into between the air jets 46 in the vicinity of the outermost circumferential air hole outlet of the burner, thereby reducing a local fuel air ratio. This produces an effect of increasing the quenching distance. Therefore, setting the intervals D1 and D2 to 1 cm or less can make the intervals D1' and D2', respectively, sufficiently shorter than the quenching distance. This can produce an effect of preventing flame adhesion. Setting the intervals D1 and D2 to 1 cm or less can produce the same effect as above also in other embodiments.

Figure 11:
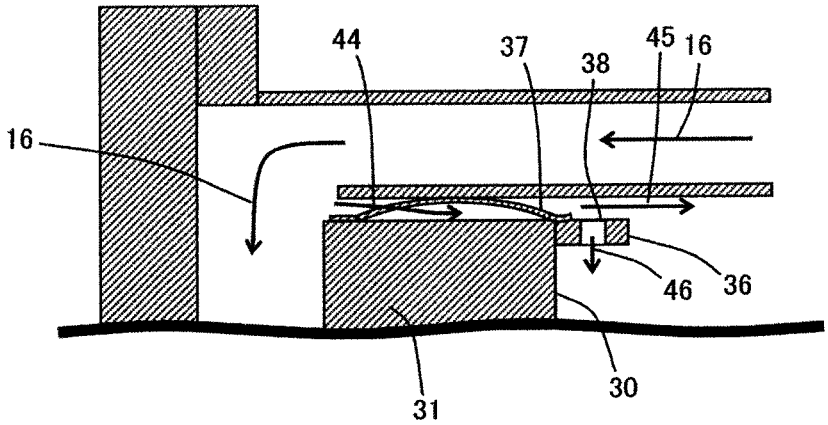
FIG. 11 is an enlarged cross-sectional view of an external burner of the combustor.

The spring-like seal member 37 is a member for obstructing the flow of air between the cylindrical guide 36 and the liner 10. If the air supply holes 38 are disposed downstream of the spring-like seal member downstream side 37*b* as shown in FIG. 11, the differential pressure between front and rear of the air supply holes does not almost occur. Therefore, after having passed the spring-like seal member 37, most of air 44 flows along the downward direction as it is and becomes leaking air 45. Because of this, a sufficient amount of air does not flow into the air supply holes, which leads to a possibility that flame cannot be prevented from adhering to the outer circumferential portion of the burner.

In contrast to this, in the present embodiment the air supply holes 38 are disposed in the range from the upstream side 37*a* to the downstream side 37*b* of the spring-like seal member with respect to the flowing direction of air 44, 45 flowing down through a gap between the liner 10 and the cylindrical guide 36 as shown in FIG. 9. The spring-like seal member downstream side 37*b* acts as resistance. A sufficient amount of air can be allowed to flow into the air supply holes 38. Thus, it is possible to suppress the adhesion of flame to the outer circumference of the external burners.

Figure 12:
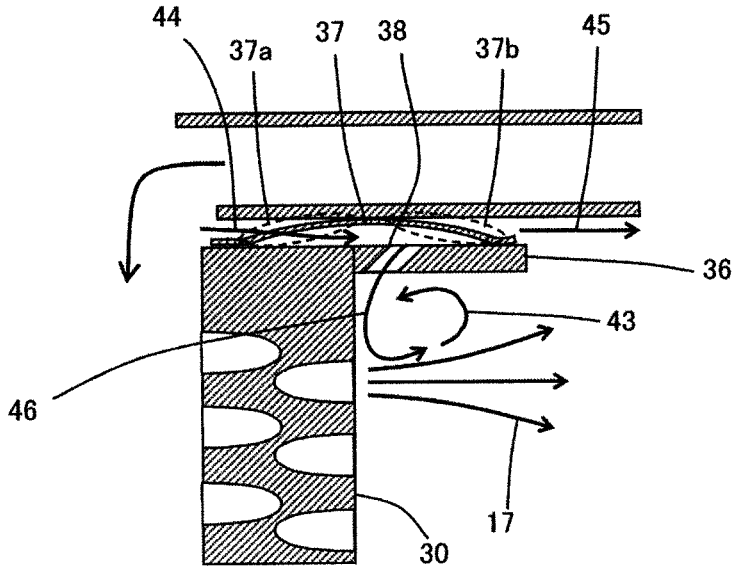
FIG. 12 is an enlarged cross-sectional view showing one of variations of the first embodiment.

As shown in FIG. 12, the air supply hole 38 may be open so as to be oriented toward the burner outlet end face 30. An air jet 46 jetted from the air supply hole 38 hits the burner outlet end face 30, then flows toward the central direction of the burner along the burner outlet end face 30 and flows into the outer circumference of the burner. Since the air jet 46 that has hit the burner outlet end face 30 also spreads in a direction vertical to the jetting direction. The interval defined between the air jets is narrowed to further reduce the intervals D1' and D2' shown in FIG. 8. Thus, it is possible to further suppress the adhesion of flame.

The present embodiment has the plurality of fuel systems as shown in FIG. 1. The fuel system 52 is connected to the fuel nozzles of the first row from the center of the external burner. The fuel system 53 is connected to the fuel nozzles of the second and third rows on the outer circumference. Gaseous fuel can separately be supplied to the fuel nozzles of the first row and to those of the second and third rows. In this way, a rate of fuel to be supplied to each of the fuel nozzles of the second and third rows on the outer circumference can be made smaller than that of the first row. Thus, it is possible to lower the concentration of the fuel in the premixed gas jetted from the outermost circumferential air holes of the burner.

The premixed gas taken in the recirculation flow 42 on the outside of the burner is premixed gas to be jetted from the outermost circumferential air holes of the burner. If flame is held on the outer circumference of the burner, the characteristics of the flame are dominated by the fuel air ratio of the premixed gas jetted from the outermost circumferential air holes of the burner. The rate of the fuel to be supplied to each of the fuel nozzles of the second and third rows on the outer circumference is made smaller than that of the first row. This can increase the frame quenching distance. Thus, it is possible to further suppress the adhesion of flame to the outer circumference of the external burners.

Figure 13:
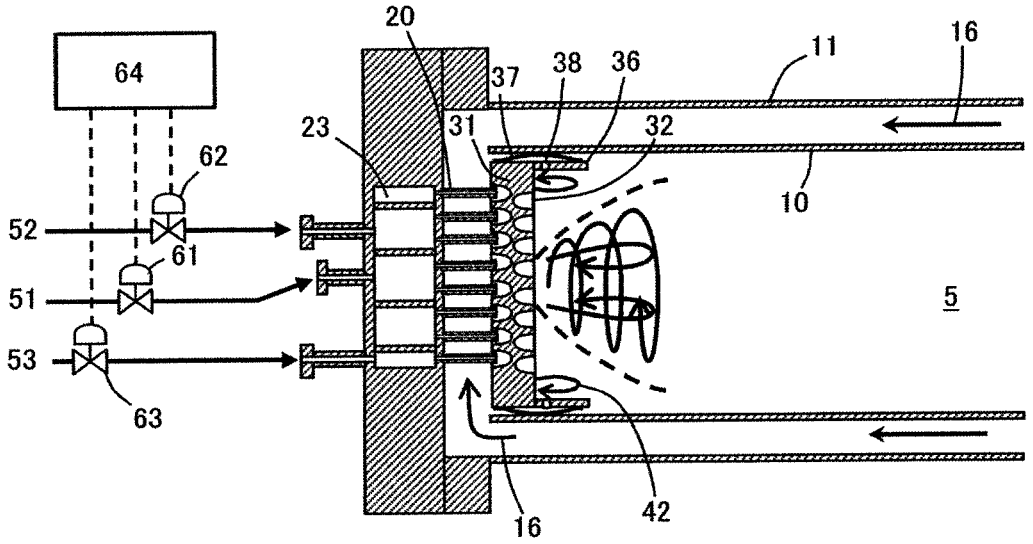
FIG. 13 is a detailed cross-sectional view of a burner portion of a gas turbine combustor as one of the variations of the first embodiment, additionally illustrating fuel systems and a control unit.

The present embodiment is configured to have the multi-burner provided with a plurality of the burners. However, the present invention is effective for a combustor provided with only one premixing burner as shown in FIG. 13. Even if the large dead spaces 35 do not exist as in the multi-burner, recirculation flows 42 are formed in the outer circumferential portion of the burner along with the flow of the premixed gas jetted from the air holes 32 similarly to the multi-burner. Therefore, if the air supply holes 38 do not exist, there is a possibility that premixed gas stays in the recirculation flows 42, so that flame is held in the outer circumferential portion of the outlet of the burner. However, as shown in the present embodiment, when the cylindrical guide 36 is provided with the air supply holes 38 and the intervals D1 and D2 are each made smaller (e.g. equal to or smaller than 1 cm) than the quenching distance in the premixed gas jetted from the outlet of the burner, it is possible to prevent flame from being held in the outer circumferential portion of the outlet of the burner, thereby making it possible to prevent the metal temperature of the liner and the burner end face from being increased.

The configuration as shown in the present embodiment is effective for also the case where a coal gasification gas, a coke-oven gasification gas or the like, which contains much hydrogen and the like, is used as fuel for a gas turbine. Hydrogen has very fast combustion velocity; therefore, flame propagates through the recirculation flow in the outer circumferential portion of the burner and is likely to be held on the circumference of the air hole outlet. However, the application of the present invention can reduce the fuel air ratio of the recirculation flow formed on the outer circumference of the external burner. This can prevent flame from propagating through the recirculation flow in the outer circumferential portion of the burner toward the upstream side. Further, since hydrogen has a very shorter quenching distance than natural gas, the cylindrical guide 36 is provided with the air supply holes 38, in addition, the flow rate of fuel supplied to the fuel system 53 shown in FIG. 1 is reduced to make a local fuel air ratio in the outer circumferential portion of the external burner smaller than in the central portion of the burner. Thus, it is effective to increase the quenching distance in the premixed gas jetted from the air holes on the outermost circumference.

(Second Embodiment)

Figure 14:
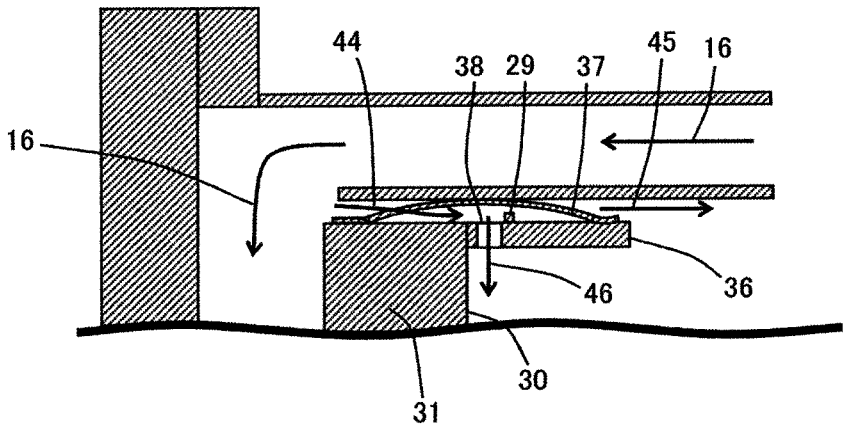
FIG. 14 is an enlarged cross-sectional view of an external burner according to a second embodiment.

A second embodiment is shown in FIG. 14. As shown in FIG. 14, air 44 that has passed a spring-like seal member passes through air supply holes 38 and flows into a chamber 5 while a portion thereof passes the spring-like seal member again as it is and flows as leaking air 45 into the chamber 5. Unlike the first embodiment, the present embodiment has a rib 29 disposed between the liner 10 and the cylindrical guide 36 and downstream of the air supply holes 38, thereby obstructing the flow of the air 44 in the axial direction of the burner. In this way, static pressure is recovered at the inlet of the air supply holes 38, whereby more air flows into the chamber 5 from the air supply holes 38.

The leaking air 45 does not contribute to the prevention of the adhesion of flame to the outer circumferential end face of the burner. If the amount of the leaking air is increased, combustion air amount is reduced to raise flame temperature, thereby increasing the discharge amount of NOx. Therefore, the amount of leaking air is suppressed to a minimum level and an amount of air necessary to prevent the adhesion of flame is supplied from the air supply holes 38. Thus, while suppressing an increase in the discharge amount of NOx, the adhesion of flame to the burner can be prevented.

Incidentally, the present embodiment exemplifies the case where the rib 29 is located on the cylindrical guide 36, as a configuration to lead air into the air supply holes 38 more effectively. However, the rib 29 is not necessarily located on the cylindrical guide 36. The rib 29 may be located between the liner 10 and the cylindrical guide 36 and on the downstream side of the air supply holes 38. This can increase the amount of air flowing into the air supply holes 38.

(Third Embodiment)

Figure 15:
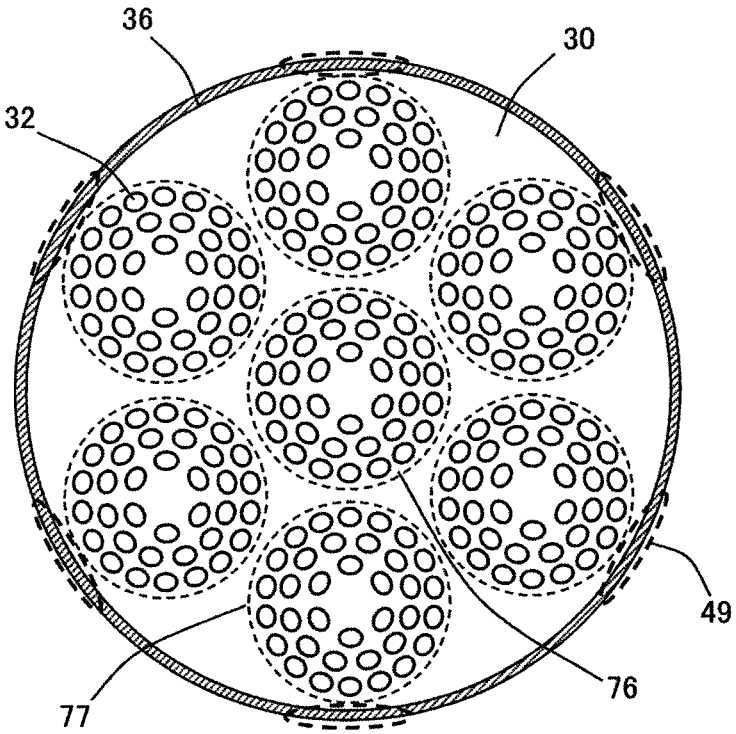
FIG. 15 is a front view of burners of a third embodiment as viewed from a chamber side.
Figure 16:
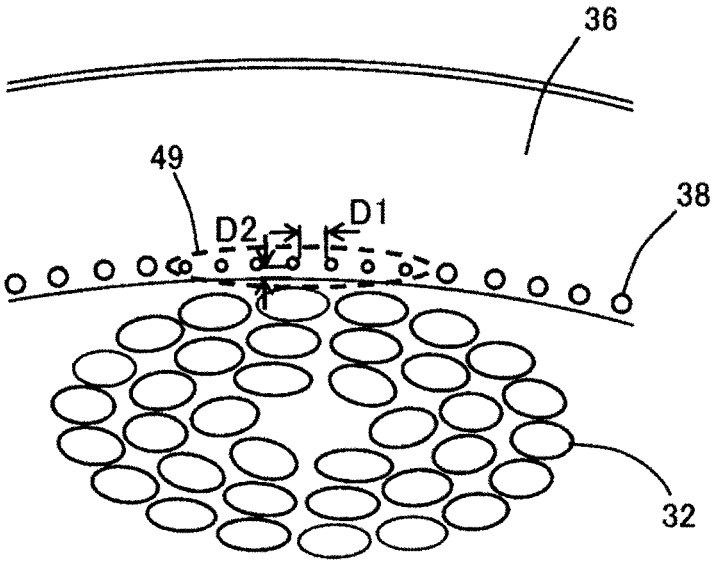
FIG. 16 is a perspective view of an external burner end face and a cylindrical guide according to the third embodiment.

A third embodiment is shown in FIGS. 15 and 16. Since the distance between air supply holes 38 in an external burner-near area 49 and external burners 77 is small as shown in FIG. 15, a flow effect of air jets 46 on the jets of premixed gas 17 is relatively greater than that from the other air supply hole on the jets of premixed gas 17. To minimize the influence of the air jets 46 on the jets of the premixed gas 17, an interval D1 defined between adjacent air supply holes 38 and an interval D2 defined between the air supply holes 38 and the burner outlet end face 30 are each made shorter than the quenching distance in the premixed gas jetted from the outermost circumferential air hole of the burner. In addition, a diameter of the air supply hole 38 in the external burner-near area 49 is made smaller than that of the air supply hole 38 in the other areas.

A jet of air has a potential core length proportional to a diameter thereof. Therefore, the decay of the jet is faster as the diameter is reduced and the premixed gas 17 can be prevented from obstruction of the flow. The amount of air supplied from the external burner-near area 49 is reduced. However, the dead space between the cylindrical guide 36 in the external burner-near area 49 and the external burner 77 is narrower than the other areas as shown in FIG. 15. In addition, also the size of the recirculation flow formed downstream of the dead space is reduced. Thus, the fuel air ratio of the recirculation flow on the outer circumferential side of the burner can be reduced by the less amount of air from the air supply holes 38.

In this way, the adhesion of flame can be suppressed over the whole circumference of the outer circumferential portion of the burner by the minimum amount of air from the air supply holes 38 and the conical flame can be formed. Further, the amount of air supplied from the air supply holes 38 is minimized, thereby making it possible to increase the amount of air flowing into the air holes 32. In addition, the lowering of a local fuel air ratio in a flame zone can reduce the discharge amount of NOx.

(Fourth Embodiment)

Figure 17:
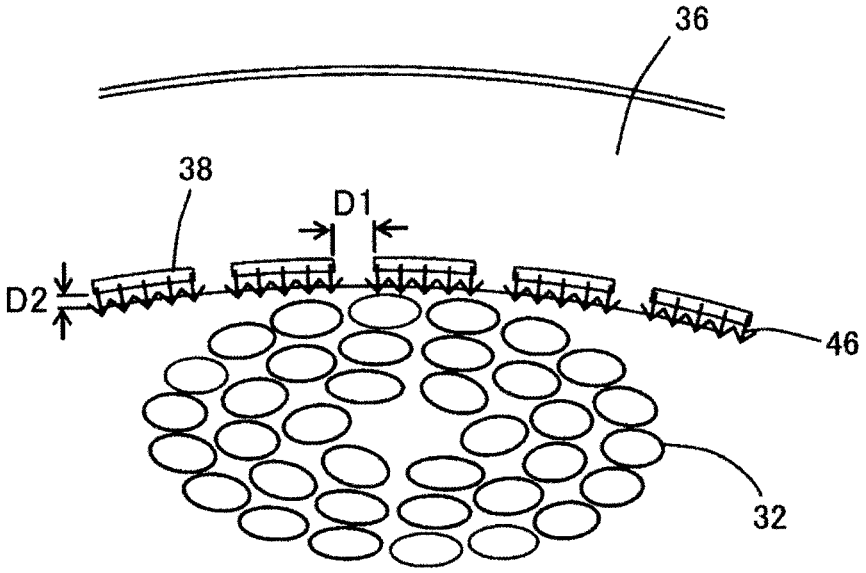
FIG. 17 is a perspective view of an external burner end face and a cylindrical guide according to the fourth embodiment.

A fourth embodiment is shown in FIG. 17. Unlike the first embodiment, the present embodiment is such that an air supply hole 38 is formed as an elongate hole in the circumferential direction of a burner. Therefore, the overall opening area of the air supply hole 38 can be increased. Similarly to the first embodiment, an interval D1 defined between adjacent air supply holes 38 and an interval D2 defined between the air supply hole 38 and the burner outlet end face 30 are each made narrower than the quenching distance in the premixed gas jetted from the outermost circumferential air hole of the burner.

The present embodiment can circumferentially supply air more uniformly than the first embodiment. In addition, the opening area of the air supply hole 38 is made sufficiently greater than the air passage sectional area of a spring-like seal member. This can slow the jet velocity of an air jet 46. Therefore, air can be supplied to the air hole outlet circumference while minimizing the obstruction of the flow of the premixed gas jetted from the air hole 32.

In this way, similarly to the first embodiment, an area where flame can be held in the circumference of the outlet of the outermost circumferential air hole of the external burner is excluded. This prevents flame from being held in the outer circumferential portion of the burner, thereby forming a stable conical flame. Thus, it is possible to prevent metal temperature from being increased.

(Fifth Embodiment)

Figure 18:
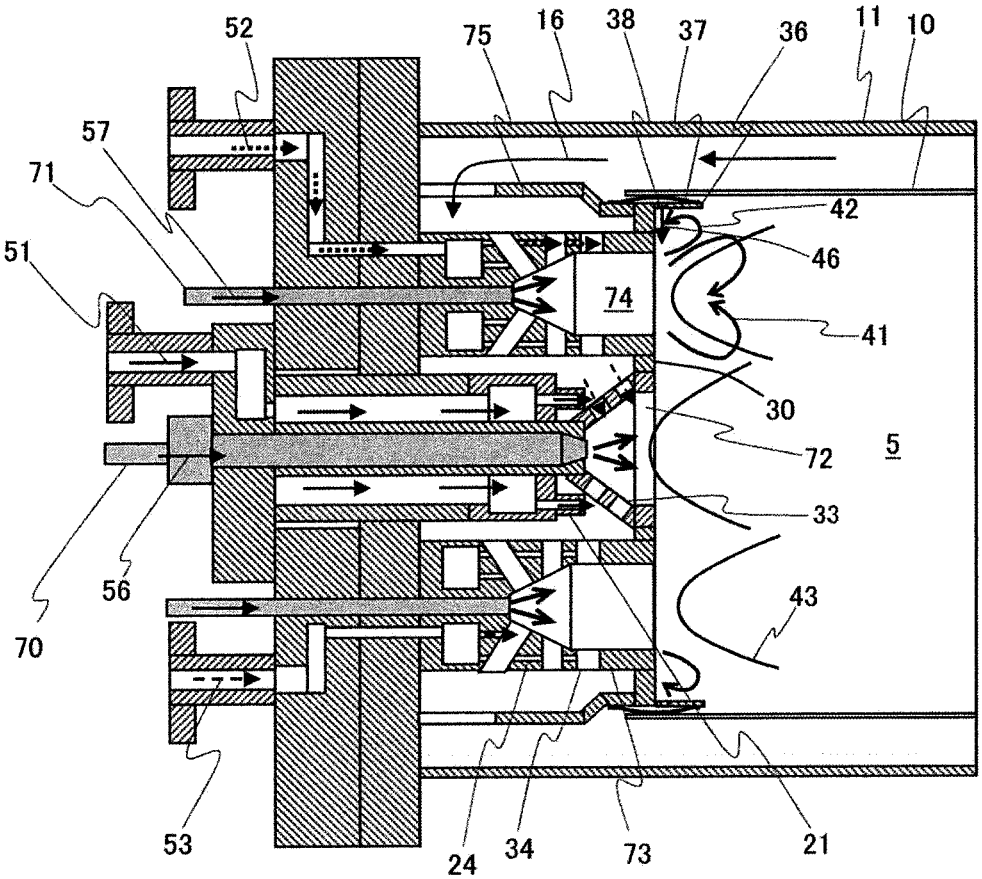
FIG. 18 is a detailed cross-sectional view of a burner portion of a gas turbine combustor according to a fifth embodiment.
Figure 19:
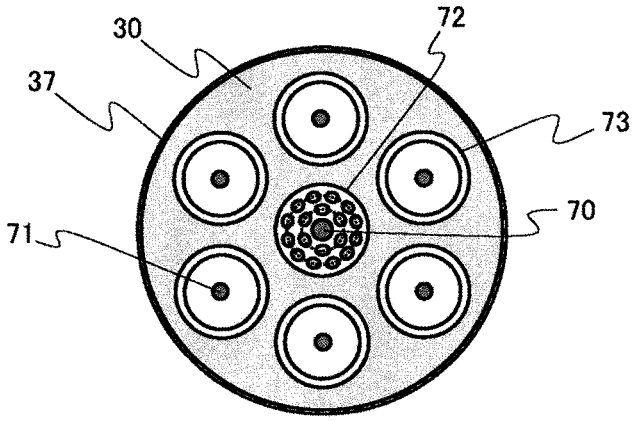
FIG. 19 is a front view of the burner of the fifth embodiment shown in FIG. 18 as viewed from the chamber side.

A combustor of a fifth embodiment is shown in FIGS. 18 and 19. The combustor of the fifth embodiment is a combustor capable of burning both liquid fuel and gaseous fuel. A diffusion burner 72 is installed upstream of an central axis of a liner 10. A plurality of premixing burners 73 effective for the promotion of NOx reduction are arranged around the diffusion burner 72. A burner main body 75 is disposed on the outer circumference of the diffusion burner 72 and the premixing burners 73 so as to hold the burners firmly. Liquid fuel nozzles 70 and 71 for jetting liquid fuels 56 and 57, respectively, are arranged at respective upstream of central axes of the burners.

The premixing burner 73 of the present embodiment has a mixing chamber 74 for promoting the mixing of fuel with air and evaporation of the liquid fuel 57 jetted from the liquid fuel nozzle 71. Air holes 34 adapted to introduce air 16 into the inside of the mixing chamber 74 are formed in the wall surface of the mixing chamber 74 in three rows (one row as well as a plurality of rows may be available) in the axial direction and in plural rows in the circumferential direction. The air holes 34 formed in the premixing burner 73 are arranged in a circumferentially deflected manner so as to form swirl flows inside the premixing chamber 74.

Gaseous fuel jet holes 24 are open in the inside wall surface of the air hole 34 of the premixing burner 73 and are adapted to jet the gaseous fuels 52, 53 into the corresponding air holes 34. Gaseous fuel and air are increasingly mixed with each other while forming swirl flows in the mixing chamber 74, and jetted as premixed gas into a chamber 5. When the premixed gas is jetted into the chamber 5, strong swirl flows 41 due to the abrupt expansion of the passage are formed downstream of the burner, which makes it possible to form stable flames 43. At the same time, recirculation flows 42 are formed also in the outer circumferential portion of the burner.

A cylindrical guide 36 is attached to the leading end of the burner main body 75 so as to hold a spring-like seam member 37. Similarly to the second embodiment, the present embodiment is such that air supply holes 38 are open in a horizontal direction with respect to a burner outlet end face 30 at a position near the burner outlet end face 30 of the cylindrical guide 36. An interval defined between adjacent air supply holes 38 and an interval defined between the air supply hole 38 and the burner outlet end face 30 are each narrower than the quenching distance of frame 43.

The air supply holes 38 as described above are provided in the cylindrical guide 36; therefore, air jets 46 can be supplied to the circumference of the burner outlet. This eliminates an area capable of serving as an origination of holding flame and reduces a fuel air ratio in a recirculation flow 42 on the outside of the burner. Therefore, flame can be prevented from adhering to the circumference of the burner outlet. Thus, it is possible to prevent the metal temperature of the liner 10 and the burner outlet end face 30 from being increased.

As described above, the combustor described in each of the embodiments has the premixing burners. The combustor provided with the cylindrical guide at the leading end of the burner is such that the cylinder guide is provided with the air supply holes. Thus, it is possible to prevent flame from being held on the outlet circumference of the premixing burners, thereby preventing the metal temperature of the liner and the burner end face from being increased.

What is claimed is:

1. A gas turbine combustor comprising:

a premixing burner for premixing gaseous fuel with air to produce a premixed gas and jetting the premixed gas into a chamber;

a cylinder disposed on an outer circumference of the premixing burner so as to surround the premixing burner and connected to a burner outlet end face which is an end face of the premixing burner at an end of the chamber; and a plurality of air supply holes formed in the cylinder configured to jet air jets that flow along the burner outlet end face; wherein an interval defined between adjacent air supply holes of the plurality of air supply holes is 1 cm or less, an interval defined between each air supply hole of the plurality of air supply holes and the burner outlet end face is 1 cm or less, the cylinder extends toward a side of the chamber further than the burner outlet end face, and the plurality of air supply holes are disposed on the side of the chamber further than the burner outlet end face.

2. The gas turbine combustor according to claim 1, wherein the premixing burner includes an air hole plate with a plurality of air holes and a plurality of fuel nozzles, wherein each of the plurality of fuel nozzles is adapted to jet the gaseous fuel into a respective one of the plurality of air holes of the air hole plate.

3. The gas turbine combustor according to claim 2, wherein the premixing burner is one of a plurality of premixing burners.

4. The gas turbine combustor according to claim 1, further comprising:

a liner for surrounding the chamber; and a seal member disposed between the liner and the cylinder inserted into the liner to secure the cylinder and the liner, the seal member obstructing a flow of air between the liner and the cylinder; wherein the plurality of air supply holes formed in the cylinder are disposed at an axial location between an upstream end of the seal member and a downstream end thereof.

5. The gas turbine combustor according to claim 1, wherein the plurality of air supply holes formed in the cylinder are open parallel to or toward the burner outlet end face of the premixing burner.

6. The gas turbine combustor according to claim 4, wherein at least one of the plurality of air supply holes has an elongate shape long in a circumferential direction of the cylinder.

7. The gas turbine combustor according to claim 4, wherein a rib for obstructing the flow of air is located between the liner and the cylinder and downstream of the plurality of air supply holes.

8. The gas turbine combustor according to claim 4, wherein a first one of the plurality of air supply holes is located closer to the premixing burner than a second one of the plurality of air supply holes, wherein the first one has a smaller diameter than the second one.

9. The gas turbine combustor according to claim 2, wherein the gas turbine combustor has a plurality of fuel systems, the premixing burner circumferentially has the plurality of air holes and the plurality of fuel nozzles arranged in a plurality of rows, the plurality of fuel nozzles includes inner circumferential side fuel nozzles connected to a first fuel system and outer circumferential side fuel nozzles connected to a second fuel system that is different from the first fuel system, and the second fuel system supplies fuel to the outer circumferential side fuel nozzles at a lower flow rate than the first fuel system supplies fuel to the inner circumferential side fuel nozzles.

10. A gas turbine combustor comprising:

a premixing burner for premixing gaseous fuel with air to produce a premixed gas and jetting the premixed gas into a chamber;

a cylinder disposed on an outer circumference of the premixing burner so as to surround the premixing burner and connected to a burner outlet end face which is an end face of the premixing burner at an end of the chamber; and a plurality of air supply holes formed in the cylinder configured to jet air jets that flow along the burner outlet end face; wherein an interval defined between adjacent air supply holes of the plurality of air supply holes is 1 cm or less, an interval defined between each air supply hole of the plurality of air supply holes and the burner outlet end face is 1 cm or less, the cylinder extends toward a side of the chamber further than the burner outlet end face, the plurality of air supply holes are disposed on the side of the chamber further than the burner outlet end face, and the plurality of air supply holes are opened toward an inner diameter side of the cylinder.

* * * * *